US006228569B1

(12) United States Patent
Maier et al.

(10) Patent No.: US 6,228,569 B1
(45) **Date of Patent: *May 8, 2001**

(54) PHOTOGRAPHIC ELEMENT COMPRISING POLYETHYLENE TEREPHTHALATE FILM BASE AND ANTIHALATION LAYER

(75) Inventors: Larry K. Maier, Rochester; Timothy F. Cilano, Pittsford; Fred D. Kelley, Webster; Frank D. Manioci, Henrietta; Diana C. Petranek, Hilton; Michael Schild, Honeoye Falls, all of NY (US)

(73) Assignee: Eastman Kodak Company, Rochester, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/315,645

(22) Filed: May 20, 1999

(51) Int. Cl.[7] ..... G03C 1/83; G03C 1/89; G03C 1/85; G03C 1/825; G03C 1/795

(52) U.S. Cl. ..... 430/522; 430/349; 430/510; 430/517; 430/527; 430/533

(58) Field of Search ..... 430/533, 349, 430/527, 510, 522, 517

(56) References Cited

U.S. PATENT DOCUMENTS

| | | | | |
|---|---|---|---|---|
| 4,141,735 | | 2/1979 | Schrader et al. | 430/533 |
| 4,478,907 | * | 10/1984 | Van Gossum et al. | 430/533 |
| 5,076,977 | | 12/1991 | Maier et al. | 264/25 |
| 5,385,704 | | 1/1995 | Tsou et al. | 264/210.7 |
| 5,466,564 | | 11/1995 | Blazey et al. | 430/533 |
| 5,607,826 | | 3/1997 | Tsou et al. | 430/533 |
| 5,679,505 | | 10/1997 | Tingler et al. | 430/527 |
| 5,723,272 | | 3/1998 | Barber et al. | 430/522 |
| 5,958,659 | * | 9/1999 | Takahashi | 430/533 |

OTHER PUBLICATIONS

US application Ser. No. 09/223,876, filed Dec. 31, 1998, titled "Process Of Making Polyethylene Terephthalate Photographic Film Base And Photographic Element Comprising Said Base".

* cited by examiner

*Primary Examiner*—Richard L. Schilling
(74) *Attorney, Agent, or Firm*—Andrew J. Anderson

(57) ABSTRACT

A silver halide light sensitive photographic element is disclosed comprising a polyethylene terephthalate film base, at least one light sensitive silver halide-containing emulsion layer, an antihalation undercoat layer, and a process-surviving antistatic backcoat, wherein the polyethylene terephthalate film base has been formed by drafting a cast resin at a stretch ratio of at least 3.4, tentering at a stretch ratio of at least 3.4, and heat-setting at an actual heat-set temperature of at least 216° C. In accordance with preferred embodiments of the invention, the polyethylene terephthalate film base of the photographic element is formed by: (a) casting a molten polyethylene terephthalate resin in a machine direction onto a casting surface to form a continuous sheet, (b) drafting the sheet by stretching in the machine direction at a stretch ratio of from 3.4 to 4, and at a temperature ranging from 70 to 130° C., (c) tentering the sheet in the transverse direction by stretching at a stretch ratio of from 3.4 to 4, and at a temperature ranging from 70 to 130 C., (d) heat-setting the tentered sheet at an actual temperature sensed by the sheet of at least 216° C., and (e) cooling the heat-set sheet without substantial detentering to obtain a stretched, heat-set polyethylene terephthalate film.

14 Claims, No Drawings

PHOTOGRAPHIC ELEMENT COMPRISING POLYETHYLENE TEREPHTHALATE FILM BASE AND ANTIHALATION LAYER

FIELD OF THE INVENTION

This invention relates to photographic elements comprising a polyethylene terephthalate film base and to a method of preparing the same. More particularly, the invention relates to photographic elements comprising a polyethylene terephthalate film base and an antihalation layer having improved properties with regard to cutting, chopping and perforating.

BACKGROUND

Polyethylene terephthalate (PET) films exhibit excellent properties for use as photographic film base with regard to transparency, dimensional stability, mechanical strength and resistance to thermal deformation. However, PET films are extremely tough and not well suited for finishing operations, i.e., slitting, chopping and perforating processes, which are required in the preparation of photographic films.

The process for making a polyethylene terephthalate film typically comprises the steps of casting a molten polyethylene terephthalate resin in a machine direction onto a casting surface to form a continuous sheet, drafting the sheet by stretching in the machine direction, tentering the sheet by stretching in the transverse direction, heat-setting the drafted and tentered sheet, and cooling the heat-set sheet to form a stretched, heat-set polyethylene terephthalate film, such as described in, e.g., U.S. Pat. No. 4,141,735, the disclosure of which is incorporated by reference herein. U.S. Pat. Nos. 5,385,704 and 5,607,826 disclose a method for improving the finishing characteristics of photographic materials employing a PET film base having reduced fracture resistance involving lowering the planar birefringence of the film base to below 0.150 by performing a detentering step which allows the tentered film to shrink in width by 2 to 20% (pref. 10–18%) after the heat-setting step during film manufacturing. Detentering, however, cannot be applied in some circumstances, e.g., when the width of the web must exceed some minimum value or when the film production machine is not properly equipped for conducting such an operation. Copending, commonly assigned U.S. Ser. No. 09/223,876, filed Dec. 31, 1998, discloses a method for making PET film base employing relatively high heat set temperatures which results in reduced fracture resistance without the need for substantial (e.g., more than 2%) detentering, and demonstrates improved perforating performance for such supports with respect to the generation of dirt. Preferred drafting stretch ratios of from 3.0 to 3.5 and tentering stretch ratios of from 2.8 to 3.3 are specified in the above referenced U.S. Pat. Nos. 5,385,704 and 5,607,826 and U.S. Ser. No. 09/223,876.

The photographic industry has long recognized the need to provide photographic elements with some form of antihalation protection. Halation has been a persistent problem with photographic films comprising one or more photosensitive silver halide emulsion layers coated on a transparent support. The emulsion layer diffusely transmits light, which then reflects back into the emulsion layer from the support surface. The silver halide emulsion is thereby reexposed at locations different from the original light path through the emulsion, resulting in "halos" on the film surrounding images of bright objects.

One method proposed for antihalation protection in photographic films comprises providing a dyed or pigmented layer behind a clear support as an antihalation backing layer, wherein the backing layer is designed to be removed during processing of the film. Typical examples of such antihalation backing layers comprise a light absorbing dye or pigment (such as carbon black) dispersed in an alkali-soluble polymeric binder (such as cellulose acetate hexahydrophthalate) that renders the layer removable by an alkaline photographic processing solution. Such carbon containing "rem-jet" backing layers have been commonly used for antihalation protection in motion picture films. The carbon particles additionally provide antistatic protection prior to being removed. While such rem-jet backing layers provide effective antihalation and antistatic protection for photographic films prior to processing, their use requires special additional processing steps for their subsequent removal, and incomplete removal of the carbon particles can cause image defects in the resulting print film. Additionally, it is often desirable to provide "process surviving" antistatic protection for photographic elements in order to prevent static build-up even after imagewise exposure and processing, especially for motion picture films which are subject to rapid transport through projection apparatus where static charges can attract dust particles which may detrimentally impact a projected image.

Accordingly, alternatives for carbon-containing, process-removable, antihalation/antistatic backing layers have been proposed. One such alternative is to use antihalation undercoat layers containing filter dyes coated between the support and the emulsion layers wherein the filter dyes are solubilized and removed and/or decolorized during processing of the film, and a separate process-surviving antistatic backing layer, such as described in U.S. Pat. Nos. 5,679,505 and 5,723,272. Dyes may be selected and used in combinations to provide antihalation protection throughout the visible spectrum. Process-surviving antistatic layers typically include, e.g., ionic polymers, electronic conducting non-ionic polymers, and metal halides or metal oxides in polymeric binders. Conductive fine particles of crystalline metal oxides dispersed with a polymeric binder have been found to be especially desirable for preparing optically transparent, humidity insensitive, antistatic layers for various imaging applications.

Photographic elements comprising PET film supports, an antihalation undercoat, and a process-surviving antistatic backcoat have been found to be particularly sensitive to finishing operations. It would be desirable to provide a PET film base for use in a photographic element with antihalation undercoat and process-surviving antistatic backcoat layers which provides improved finishing characteristics, especially a film base which provides for photographic elements with an improved overall dirt position after both slitting and perforating operations.

SUMMARY OF THE INVENTION

In accordance with one embodiment of the invention, a silver halide light sensitive photographic element is disclosed comprising a polyethylene terephthalate film base, at least one light sensitive silver halide-containing emulsion layer, an antihalation undercoat layer, and a process-surviving antistatic backcoat, wherein the polyethylene terephthalate film base has been formed by drafting a cast resin at a stretch ratio of at least 3.4, tentering at a stretch ratio of at least 3.4, and heat-setting at an actual heat-set temperature of at least 216° C. In accordance with preferred embodiments of the invention, the polyethylene terephthalate film base of the photographic element is formed by:

(a) casting a molten polyethylene terephthalate resin in a machine direction onto a casting surface to form a continuous sheet, (b) drafting the sheet by stretching in the machine direction at a stretch ratio of from 3.4 to 4, and at a temperature ranging from 70 to 130° C., (c) tentering the sheet in the transverse direction by stretching at a stretch ratio of from 3.4 to 4, and at a temperature ranging from 70 to 130° C., (d) heat-setting the tentered sheet at an actual temperature sensed by the sheet of at least 216° C., and (e) cooling the heat-set sheet without substantial detentering to obtain a stretched, heat-set polyethylene terephthalate film.

In accordance with the invention, improved finishing performance of photographic elements employing a PET film base, antihalation undercoat, and process-surviving antistatic backing layer is achieved with respect to combined total dirt formed upon slitting and perforating finishing operations. While improved perforating finishing performance with respect to dirt generation is demonstrated for the films obtained in accordance with the use of relatively low stretch ratios in the drafting and tentering steps in combination with a relatively high heatsetting temperature as demonstrated in U.S. Ser. No. 09/223,876 referenced above, for photographic elements comprising an antihalation undercoat and process-surviving backcoat it has been found that the use of higher stretch ratios for the PET film in accordance with the instant invention in combination with sufficiently high heatsetting temperatures results in improved slitting performance in combination with good perforating performance, and leads to further improved overall performance of such photographic films with respect to total dirt generation upon finishing. Advantageously, such improved overall performance is obtained without the need for substantial detentering of the PET film after heat-setting to obtain a planar birefringence of the PET film below 0.150 as taught by U.S. Pat. Nos. 5,385,704 and 5,607,826.

DETAILED DESCRIPTION OF THE INVENTION

In the process for preparing a polyethylene terephthalate film for use in the elements of the invention, a polyethylene terephthalate resin may be cast under molten conditions upon a cooling surface to form a continuous sheet. Preferably, the molten polyester resin has an inherent viscosity of from 0.5 to 0.8 dl/g, more preferably from 0.55 to 0.7, and is cast at a temperature of from 270 to 300° C. while the casting surface has a temperature of from 40 to 70° C. The inherent viscosity (IV) is measured at 25° C. in a solvent mixture of phenol/chlorobenzene (60/40 by weight) at a concentration of 0.25 g/dl with a Ubbelhode glass viscometer.

The continuous sheet is removed from the casting surface and passed into a drafting zone where it is first preheated and then stretched in the machine direction at a stretch ratio of at least 3.4, preferably at a stretch ratio of from 3.4 to 4.0, more preferably from 3.5 to 4.0 and most preferably from 3.6 to 4.0, at a temperature of from about 70° C. to 130° C., preferably from about 85° C. to 110° C., and more preferably from about 90° C. to 105° C. The drafting zone typically includes two sets of nipped rollers, the first being the entrance to the drafting zone and the second the exit from the drafting zone. To achieve the stretch ratios necessary for the practice of this invention, the exit nip rollers are rotated at a speed greater than the entrance nip rollers. The film may be cooled in the last stage of the drafting zone to from 25° C. to 40° C.

The film moves from the drafting zone into a tentering zone where it is preheated and stretched in the transverse direction at a stretch ratio of at least 3.4, preferably at a stretch ratio of from 3.4 to 4.0, more preferably from 3.5 to 4.0 and most preferably from 3.6 to 4.0, at a temperature of from about 70° C to 130° C., preferably from about 90° C. to 115° C., and more preferably from about 95° C. to 110° C. The tentering zone typically includes a means for engaging the film at its edges and stretching such that the final width is up to 4.0 times that of the original width. The film is next heatset in accordance with the invention by maintaining it at a temperature of at least 216° C. but below the melting point of the resin, preferably from at least 224° C. to 250° C. and more preferably from about 230° C. to 250° C., while being constrained as in the tentering zone for a time sufficient to affect heatsetting. Times longer than necessary to bring about this result are not detrimental to the film; however, longer times are undesired as the lengthening of the zone requires higher capital expenditure without achieving additional advantage. The heat-setting step is typically accomplished within a time period of 0.1 to 15 and preferably 1 to 10 seconds. Finally, the film is cooled, preferably without substantial detentering (the means for holding the edges of the film preferably do not permit greater than 2% shrinkage thereof). Preferably, a film having a planar birefringence of from 0.164 to 0.15 is obtained.

The actual temperature sensed by the film during the heat-setting step may be determined by the differential scanning calorimetry (DSC) technique. The DSC heat-set temperature represents the actual heat-set temperature. The actual temperature sensed by the film is often different from the set heat-set temperature applied in the process, and it sometimes depends on the position of the material sample across the web. The DSC heat-set temperature may be determined by scanning a test sample (as-received) by a conventional DSC apparatus (e.g., DuPont 990 Thermal Analyzer) at a rate of 10° C./min from ambient to approx. 300° C. The thermogram produced by the scan will contain two distinct endothennic peaks: (1) a high temperature peak, which usually falls in the range 250–260° C., represents the primary melting range of PET; and (2) a much smaller peak detected at a lower temperature for films heat-set under standard conditions. The position of this secondary melting peak is closely dependent on the heat-set temperature applied in the process and it represents the actual temperature sensed by the material during heat-setting.

The term planar birefringence is used to describe the difference between the average refractive index in the film plane and the refractive index in the thickness direction. That is, the refractive indices in the machine direction and the transverse direction are totaled, divided by two and then the refractive index in the thickness direction is subtracted from this value to yield the value of the planar birefringence. Refractive indices are measured using an Abbe-3L refractometer based on a procedure set forth in Encyclopedia of Polymer Science & Engineering, Vol. 14, Wiley, N.Y., 1988, pg. 261.

Photographic elements comprising an antihalation undercoat, a process-surviving backcoat and a PET film base having the properties set forth above and prepared by the process described above generate significantly reduced total amount of dirt and debris upon being slit and perforated to produce photographic film when compared with photographic elements comprising PET films which are stretched at lower ratios and which are heat-set at lower temperatures in accordance with typical prior art practice.

Photographic elements of the invention can be black-and-white or single color elements, but preferably are multicolor elements. Multicolor elements typically contain image dye-forming units sensitive to each of the three primary regions of the visible spectrum, i.e. blue (about 400 to 500 nm), green (about 500 to 600 nm), and red (about 600 to 760 nm) sensitive image dye-forming units. Each unit can comprise a single emulsion layer or multiple emulsion layers sensitive to a given region of the spectrum. The layers of the element, including the layers of the image-forming units, can be arranged in various orders as known in the art. The invention is particularly applicable to photographic print elements designed for exposure though a negative film and projection display, such as motion picture print and intermediate films.

The invention is particularly useful with color photographic print elements. In color photographic element printing, there are usually three records to record in the image area frame region of a print film, i.e., red, green and blue. The original record to be reproduced is preferably an image composed of sub-records having radiation patterns in different regions of the spectrum. Typically it will be a multicolor record composed of sub-records formed from cyan, magenta and yellow dyes. The principles by which such materials form a color image are described in James, The Theory of the Photographic Process, Chapter 12, Principles and Chemistry of Color Photography, pp 335–372, 1977, Macmillan Publishing Co. New York, and suitable materials useful to form original records are described in *Research Disclosure,* December, 1987, Item 17643, published by Industrial Opportunities Ltd., Homewell Havant, Hampshire, P09 1EF, United Kingdom, and *Research Disclosure,* September 1994, Item 36544, published by Kenneth Mason Publications, Ltd., Emsworth, Hampshire P010 7DQ, England. Materials in which such images are formed can be exposed to an original scene in a camera, or can be duplicates formed from such camera origination materials, such as records formed in color negative intermediate films such as those identified by the tradenames Eastman Color Intermediate Films 2244, 5244 and 7244. Alternatively, the original record may be in the form of electronic image data, which may be used to control a printer apparatus, such as a laser printer, for selective imagewise exposure of a print film in accordance with the invention.

The photographic element of the invention preferably comprises a support bearing light sensitive image dye forming layers sensitized to the blue, green, and red regions of the electromagnetic spectrum. In accordance with a preferred embodiment of the invention, the element comprises cyan, magenta and yellow dye forming silver halide emulsion layers sensitized to the red, green and blue regions of the spectrum. Such materials are described in the Research Disclosure publications cited above. It is within the scope of this invention for the light sensitive material to also be sensitive to one or more regions of the electromagnetic spectrum outside the visible, such as the infrared region of the spectrum. In most color photographic systems, color-forming couplers are incorporated in the light-sensitive photographic emulsion layers so that during development, they are available in the emulsion layer to react with the color developing agent that is oxidized by silver halide image development. Diffusible couplers are used in color developer solutions. Non-diffusing couplers are incorporated in photographic emulsion layers. When the dye image formed is to be used in situ, couplers are selected which form non-diffusing dyes. Color photographic systems can also be used to produce black-and-white images from non-diffusing couplers as described by Edwards et al. in International Publication No. WO 93/012465.

In the following discussion of suitable materials for use in the emulsions and elements that can be used in conjunction with the invention, reference will be made to *Research Disclosure,* September 1994, Item 36544, available as described above, which will be identified hereafter by the term "*Research Disclosure.*" The Sections hereafter referred to are Sections of the *Research Disclosure,* Item 36544.

Suitable silver halide emulsions and their preparation as well as methods of chemical and spectral sensitization are described in Sections I, and III–IV. Vehicles and vehicle related addenda are described in Section II. Dye image formers and modifiers are described in Section X. Various additives such as UV dyes, brighteners, luminescent dyes, antifoggants, stabilizers, light absorbing and scattering materials, coating aids, plasticizers, lubricants, antistats and matting agents are described, for example, in Sections VI–IX. Layers and layer arrangements, color negative and color positive features, scan facilitating features, supports, exposure and processing conditions can be found in Sections XI–XX.

It is also contemplated that the materials and processes described in an article titled "Typical and Preferred Color Paper, Color Negative, and Color Reversal Photographic Elements and Processing," published in *Research Disclosure,* February 1995, Item 37038 also may be advantageously used with elements of the invention.

Photographic light-sensitive materials of the invention may utilize silver halide emulsion image forming layers wherein chloride, bromide and iodide are present as a mixture or combination of at least two halides. The combinations significantly influence the performance characteristics of the silver halide emulsion. As explained in Atwell, U.S. Pat. No. 4,269,927, silver halide with a high chloride content possesses a number of highly advantageous characteristics. For example, high chloride silver halides are more soluble than high bromide silver halides, thereby permitting development to be achieved in shorter times. Furthermore, the release of chloride into the developing solution has less restraining action on development compared to bromide and this allows developing solutions to be utilized in a manner that reduces the amount of waste developing solution.

Couplers that may be used in the elements of the invention can be defined as being 4-equivalent or 2-equivalent depending on the number of atoms of $Ag^+$ required to form one molecule of dye. A 4-equivalent coupler can generally be converted into a 2-equivalent coupler by replacing a hydrogen at the coupling site with a different coupling-off group. Coupling-off groups are well known in the art. Such groups can modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, alkylthio (such as mercaptopropionic acid), arylthio, phosphonyloxy and arylazo. These coupling-off groups are described in the art, for example, in U.S. Pat. Nos. 2,455,169; 3,227,551; 3,432,521; 3,476,563; 3,617,291; 3,880,661; 4,052,212 and 4,134,766; and in U.K. Patents and published application Nos. 1,466,728; 1,531,927; 1,533,039; 2,006,755A and 2,017,704A.

Couplers that form magenta dyes upon reaction with oxidized color developing agent which can be incorporated in elements of the invention are described in such representative patents and publications as: U.S. Pat. Nos. 2,600,788; 2,369,489; 2,343,703; 2,311,082; 2,908,573; 3,062,653; 3,152,896; 3,519,429; 4,853,319; 5,250,400 and "Farbkuppler—Eine Literature Ubersicht," published in Agfa Mitteilungen, Band III, pp. 126–156 (1961). Preferably such couplers are pyrazolones, pyrazolotriazoles, or pyrazolobenz idazoles that form magenta dyes upon reaction with oxidized color developing agents.

Couplers that form cyan dyes upon reaction with oxidized color developing agents which may be included in elements of the invention include those which are described in such representative patents and publications as: U.S. Pat. Nos. 2,367,531; 2,423,730; 2,474,293; 2,772,162; 2,895,826; 3,002,836; 3,034,892; 3,041,236; 4,883,746 and "Farbkuppler—Eine Literature Ubersicht," published in Agfa Mitteilungen, Band III, pp. 156–175 (1961). Preferably such couplers are phenols and naphthols that form cyan dyes on reaction with oxidized color developing agent. Also preferable are the cyan couplers described in, for instance, European Patent Application Nos. 544,322; 556,700; 556,777; 565,096; 570,006; and 574,948.

Couplers that form yellow dyes upon reaction with oxidized color developing agent and which are useful in elements of the invention are described in such representative patents and publications as: U.S. Pat. Nos. 2,875,057; 2,407,210; 3,265,506; 2,298,443; 3,048,194; 3,447,928 and "Farbkuppler—Eine Literature Ubersicht," published in Agfa Mitteilungen, Band III, pp. 112–126 (1961). Such couplers are typically open chain ketomethylene compounds. Also preferred are yellow couplers such as described in, for example, European Patent Application Nos. 482,552; 510,535; 524,540; 543,367; and U.S. Pat. No. 5,238,803.

To control the migration of various components coated in a photographic layer, including couplers, it is preferable to include a high molecular weight hydrophobe or "ballast" group in the component molecule. It may be useful to use a combination of couplers any of which may contain known ballasts or coupling-off groups such as those described in U.S. Pat. Nos. 4,301,235; 4,853,319 and 4,351,897.

Suitable vehicles for the emulsion layer and other layers of elements of this invention include hydrophilic colloids such as described in *Research Disclosure,* Section II and the publications cited therein. In preferred embodiments of the invention, the hydrophilic colloid is gelatin. This may be any gelatin or modified gelatin such as acetylated gelatin, phthalated gelatin, oxidized gelatin, etc. Gelatin may be base-processed, such as lime-processed gelatin, or may be acid-processed, such as acid processed ossein gelatin. The hydrophilic colloid may be another water-soluble polymer or copolymer including, but not limited to poly(vinyl alcohol), partially hydrolyzed poly(vinylacetate/vinylalcohol), hydroxyethyl cellulose, poly(acrylic acid), poly(1-vinylpyrrolidone), poly(sodium styrene sulfonate), poly(2-acrylamido-2-methane sulfonic acid), polyacrylamide. Copolymers of these polymers with hydrophobic monomers may also be used.

Photographic elements of the invention comprise an antihalation undercoat layer comprising process removable or decolorizable filter dyes located between a light sensitive layer of the element and the polyethylene terephthalate film support. Depending upon the layer arrangement and sensitivities of the various layers of the element, different antihalation filter dyes may be incorporated in separate antihalation layers. For example, where the element comprises a support bearing in order separate blue-sensitive, red-sensitive, and green-sensitive silver halide layers coated thereon (which is a preferred arrangement for motion picture color print films), a yellow-colored, blue-light absorbing dye containing layer may be coated between the support and the blue-sensitive layer, and a cyan-colored, red-light absorbing dye containing layer may be coated between the blue-sensitive layer and the red-sensitive layer. In preferred embodiments of the invention, however, blue-light and red-light absorbing antihalation dyes are both incorporated in an antihalation layer coated between the support and all silver halide emulsion layers thereon.

The antihalation undercoat of the photographic elements in accordance with the invention preferably comprise filter dyes which are incorporated in the form of solid particle dispersions which are readily solubilized and removed or decolorized upon standard photographic processing. Preferred filter dyes that can be used in the form of solid particle dispersions include those which are substantially insoluble at aqueous coating pH's of less than 7, and readily soluble or decolorizable in aqueous photographic processing solutions at pH of 8 or above, so as to be removed from or decolorized in a photographic element upon photographic processing. By substantially insoluble is meant dyes having a solubility of less than 1% by weight, preferably less than 0.1% by weight. Such dyes are generally of the formula:

$$D—(X)_n$$

where D represents a residue of a substantially insoluble compound having a chromophoric group, X represents a group having an ionizable proton bonded to D either directly or through a bivalent bonding group, and n is 1–7. The residue of a compound having a chromophoric group may be selected from conventional dye classes, including, e.g., oxonol dyes, merocyanine dyes, cyanine dyes, arylidene dyes, azomethine dyes, triphenylmethane dyes, azo dyes, and anthraquinone dyes. The group having an ionizable proton preferably has a pKa (acid dissociation constant) value measured in a mixed solvent of water and ethanol at 1:1 volume ratio within the range of 4 to 11, and may be, e.g., a carboxyl group, a sulfonamido group, a sulfamoyl group, a sulfonylcarbamoyl group, a carbonylsulfamoyl group, a hydroxy group, and the enol group of a oxanol dye or ammonium salts thereof. The filter dye should have a log P hydrophobicity parameter of from 0–6 in its non-ionized state. Such general class of ionizable filter dyes is well known in the photographic art, and includes, e.g., dyes disclosed for use in the form of aqueous solid particle dye dispersions as described in International Patent Publication WO 88/04794, European patent applications EP 594 973; EP 549 089; EP 546 163 and EP 430 180; U.S. Pat. Nos. 4,803,150; 4,855,221; 4,857,446; 4,900,652; 4,900,653; 4,940,654; 4,948,717; 4,948,718; 4,950,586; 4,988,611; 4,994,356; 5,098,820; 5,213,956; 5,260,179; and 5,266,454; the disclosures of each of which are herein incorporated by reference. Such dyes are generally described as being insoluble in aqueous solutions at pH below 7, and readily soluble or decolorizable in aqueous photographic processing solutions at pH 8 or above.

Preferred dyes of the above formula include those of formula:

$$[D—(A)_y]—X_n$$

where D, X and n are as defined above, and A is an aromatic ring bonded directly or indirectly to D, y is 0 to 4, and X is bonded either on A or an aromatic ring portion of D.

Exemplary dyes of the above formulas include those in Tables I to X of WO 88/04794, formulas (I) to (VII) of EP 0 456 163 A2, formula (II) of EP 0 594 973, and Tables I to XVI of U.S. Pat. No. 4,940,654 incorporated by reference above.

It is especially preferable to include a yellow-colored, blue-light absorbing filter dye in an antihalation layer in combination with a cyan-colored, red-light absorbing barbituric acid oxonol filter dye, such as the dyes disclosed for use in the antihalation layers of the photographic elements described in U.S. Pat. Nos. 4,770,984 and 5,723,272, the disclosures of which are hereby incorporated by reference herein. Exemplary blue-light absorbing dyes include the merostyryl dyes of formula (1) and monomethine oxonol dyes of formula (II) of U.S. Pat. No. 4,770,984. Additional preferred yellow dyes include yellow arylidene dyes of the above referenced solid particle dye patents. Preferred barbituric acid oxonol filter dyes include those of formula (I) of U.S. Pat. No. 5,723,272.

In preferred embodiments of the invention, the antihalation undercoat layer is a hydrophilic colloid layer, the hydrophilic colloid preferably being gelatin. This may be any gelatin or modified gelatin, or another water-soluble polymer or copolymer or mixtures thereof with gelatin, as referenced above. The antihalation layer is preferably present between the silver halide emulsion layer and the polyethylene terephthalate film base.

For effective safelight and antihalation protection, antihalation filter dyes are preferably incorporated into the antihalation layers of the invention at coverages to provide optical densities of from about 0.3 to 1.5 across the visible spectrum prior to processing and removal. In accordance with a preferred embodiment of the invention, antihalation dyes are incorporated to provide optical densities of from 0.3–1.0 in the blue and red regions, and from 0.5–1.5 in the green region prior to processing and removal. For optimized safelight and antihalation protection, in preferred embodiments of the invention, a blue light absorbing (yellow colored) merostyryl, monomethine oxonol and/or arylidene filter dye is used at a combined coverage of from about 10–500 mg/m$^2$ (more preferably 25–100 mg/m$^2$), a red light absorbing barbituric acid oxonol filter dye is used at coverage from about 10–500 mg/m$^2$ (more preferably 25–100 mg/m$^2$).

The photographic elements of the invention additionally comprise an antistatic layer coated on the opposite side of the element support relative to the element's light sensitive image forming layers. The antistatic layer is preferably transparent and process surviving, and may include a protective overcoat layer to provide abrasion resistance and/or enhanced frictional characteristics. Any antistatic materials such as those previously suggested for use with photographic elements may be used in the antistatic layer. Such materials include, e.g., ionic polymers, electronic conducting non-ionic polymers, and metal halides or metal oxides in polymer binders. Conductive fine particles of crystalline metal oxides dispersed with a polymeric binder have been used to prepare optically transparent, humidity insensitive, antistatic layers for various imaging applications. Many different metal oxides, such as AnO, $TiO_2$, $ZrO_2$, $Al_2O_3$, $SiO_2$, MgO, BaO, $MoO_3$, and $V_2O_5$, are disclosed as useful as antistatic agents in photographic elements or as conductive agents in electrostatographic elements in such patents as U.S. Pat. Nos. 4,275,103; 4,394,441; 4,416,963; 4,418,141; 4,431,764; 4,495,276; 4,571,361; 4,999,276; and 5,122,445. Preferred metal oxides include antimony-doped tin oxide and vanadium pentoxide which have been found to provide acceptable performance characteristics in demanding environments.

Preferred binders which may be included in the antistatic layer of the photographic elements of the invention include vinylidene chloride-containing polymer latexes and polyesterionomer dispersions, which can improve the integrety of the antistatic layer and the adhesion of the layer to the support. Polyesterionomers refers to polyesters that contain at least one ionic moiety. Such ionic moieties function to make the polymer water dispersable. These polymers are prepared by reacting one or more dicarboxylic acids or their functional equivalents such as anhydrides, diesters, or diacid halides with one or more diols in melt-phase polycondensation reactions well known in the art as shown in U.S. Pat. Nos. 3,018,272; 3,929,489; 4,307,174 and 4,419,437. Examples of this class of polymers include, for example, Eastman™ AQ polyesterionomers manufactured by Eastman Chemical Company.

In accordance with a particularly preferred embodiment of the invention, the antistatic layer contains a colloidal gel of vanadium pentoxide or silver-doped vanadium pentoxide as described in U.S. Pat. Nos. 4,203,769, 5,006,451, 5,221, 598 and 5,284,714. The antistatic layer described in U.S. Pat. No. 4,203,769 is prepared by coating an aqueous colloidal solution of vanadium pentoxide. Preferably, the vanadium pentoxide is doped with silver. A polymer binder, such as a cationic vinylidene-chloride-containing terpolymer latex or a polyesterionomer dispersion as described above, is preferably employed in the antistatic layer to improve the integrity of the layer and to improve adhesion to the undercoat layer. Typically the dried coating weight of the vanadium pentoxide antistatic material is about 0.5 to 30 mg/m2. The weight ratio of polymer binder to vanadium pentoxide can range from about 1:5 to 500:1 , but, preferably 1:1 to 10:1. Typically, the antistatic layer is coated at a dry coverage of from 1 to 400 mg/m2 based on total dry weight. The electrical resistivity of the antistatic layer is preferably from about 7 to about 11 log ω/square, and most preferably about 9 log ω/square.

The antistatic coating formulation may also contain a coating aid to improve coatability. The common level of coating aid in the antistatic coating formula is 0.01 to 0.30 weight percent active coating aid based on the total solution weight. However, the preferred level of coating aid is 0.02 to 0.20 weight percent active coating aid based on total solution weight. These coating aids can be either anionic or nonionic coating aids such as paraisononyphenoxy-glycidol ethers, octylphenoxypolyethoxy ethanol, sodium salt of alkylaryl polyether sulfonate, and dioctyl esters of sodium sulfosuccinic acid, which are commonly used in aqueous coatings. The coating may be applied onto the film support using coating methods well known in the art such as hopper coating, skim pan/air knife, gravure coating, and the like.

To provide protection of the antistatic layer in the elements of the invention, a protective overcoat may be applied thereon. The protective layer can chemically isolate the antistatic layer and also serve to provide scratch and abrasion resistance. The protective overcoat layers may be, e.g., cellulose esters, cellulose nitrate, polyesters, acrylic and methacrylic copolymers and homopolymers, polycarbonates, polyvinyl formal, polymethyl methacrylate, polysilicic acid, polyvinyl alcohol, and polyurethanes. Such layers may be aqueous coated or organic solvent coated as appropriate. The antistatic layer may also be overcoated with a barrier layer comprising a latex polymer having hydrophilic functionality as disclosed in U.S. Pat. No. 5,006,451 if desired. Such barrier layers provide excellent adhesion between vanadium pentoxide antistatic layers and overlying layers. A protective topcoat may also be preferably used which comprises a polyurethane binder and a lubricant, where the polyurethane binder has a tensile elongation to break of at least 50% and a Young's modulus measured at 2% elongation of at least 50,000 lb/in$^2$, as disclosed in U.S. Pat. No. 5,679,505. These physical property requirements insure that the topcoat layer is hard yet tough to simultaneously provide excellent abrasion resistance and outstanding resiliency to allow the topcoat and antistat layer to survive hundreds of cycles through a motion picture projector. Preferably, the polyurethane is an aliphatic polyurethane. Aliphatic polyurethanes are preferred due to their excellent thermal and UV stability and freedom from yellowing. The polyurethane topcoat is preferably coated from a coating formula containing from about 0.5 to about 10.0 weight percent of polymer to give a dry coverage of from about 50 to about 3000 mg/m$^2$. The dry coverage of the topcoat layer is preferably from about 300 to 2000 mg/m$^2$.

The chemical resistance of the antistatic layer or an overcoat can be improved by incorporating a polymer cross-linking agent into the antistatic layer or those overcoats that have functionally cross-linkable groups. Cross-linking agents such as aziridines, carbodiimide, epoxys, and the like are suitable for this purpose.

A suitable lubricant may also be included in the antistatic layer or protective overcoat in order to provide desired friction performance to assure good transport characteristics during manufacturing and handling of the elements of the invention. Many lubricating agents can be used including higher alcohol esters of fatty acids, higher fatty acid calcium salts, metal stearates, silicone compounds, paraffins and the like. Suitable lubricants include silicone oil, silicones having polar groups, fatty acid-modified silicones, fluorine-containing silicones, fluorine-containing alcohols, fluorine-containing esters, polyolefins, polyglycols, alkyl phosphates and alkali metal salts thereof, alkyl sulfates and alkali metal salts thereof, polyphenyl ethers, fluorine-containing alkyl sulfates and alkali metal salts thereof, monobasic fatty acids having 10 to 24 carbon atoms (which may contain unsaturated bonds or may be branched) and metal salts thereof (such as Li, Na, K and Cu), monovalent, divalent, trivalent, tetravalent, pentavalent and hexavalent alcohols having 12 to 22 carbon atoms (which may contain unsaturated bonds or may be branched), alkoxy alcohols having 12 to 22 carbon atoms, mono-, di- and tri-esters of monobasic fatty acids having 10 to 24 carbon atoms (which may contain unsaturated bonds or may be branched) and one of monovalent, divalent, trivalent, tetravalent, pentavalent and hexavalent alcohols having 2 to 12 carbon atoms (which may contain unsaturated bonds or may be branched), fatty acid esters of monoalkyl ethers of alkylene oxide polymers, fatty acid amides having 8 to 22 carbon atoms and aliphatic amines having 8 to 22 carbon atoms. Specific examples of these compounds (i.e., alcohols, acids or esters) include lauric acid, myristic acid, palmitic acid, stearic acid, behenic acid, butyl stearate, oleic acid, linolic acid, linolenic acid, elaidic acid, octyl stearate, amyl stearate, isooctyl stearate, octyl myristate, butoxyethyl stearate, anhydrosorbitan monostearate, anhydrosorbitan distearate, anhydrosorbitan tristearate, pentaerythrityl tetrastearate, oleyl alcohol and lauryl alcohol. Aqueous dispersed lubricants are preferred as they may be directly incorporated into an aqueous antistatic or overcoat layer, thus avoiding the need for a separately applied lubricant layer. The aqueous dispersed lubricants of carnauba wax and stearates are preferred for their effectiveness in controlling friction at low lubricant levels and their excellent compatibility with aqueous overcoat polymer solutions.

Matting agents may also be included in the antistatic layer or overcoat thereon in order to improve transport properties of the elements of the invention on manufacturing, printing, processing, and projecting equipment. Such matting agents can also help prevent sticking between the front and back sides of the elements in a tightly wound roll. Matting agents may be, e.g., silica, calcium carbonate, other mineral oxides, glass spheres, ground polymers and high melting point waxes, and polymeric matte beads.

The antistatic layer may also contain a coating aid to improve coatability, including anionic or nonionic coating aids such as para-isononylphenoxyglycidol ethers, octylphenoxy polyethoxy ethanol, sodium salts of alkylaryl polyether sulfonates, and dioctyl esters of sodium sulfosuccinic acid. Such coating aids are typically used at from 0.01 to 0.30 weight percent based on the total coating solution weight.

In accordance with a preferred embodiment of the invention, surface charge differential between the emulsion side and back side is minimized. Preferably, the surface charge differential is controlled to be less than 12 microcoulombs/m$^2$, more preferably less than 6 rnicrocoulombs/m$^2$. Surface charges may be controlled by selection of surface layer composition and surfactant levels. Possible techniques for controlling surface charges of photographic elements include those, e.g., disclosed in U.S. Patent Nos. 5,866,285, 5,874,191, and 5,888,712, the disclosures of which are incorporated by reference. In a preferred embodiment of the invention, a fluorinated surfactant, such as Fluorotenside FT-248, the tetraethylammonium salt of perfluorooctyl sulfonic acid (Bayer AG) may be used at levels of from about 1–20 mg/m$^2$ in a protective overcoat coated over the emulsion layers of the photographic element. Optimized levels of surface charge controlling components will be dependent upon overall film compositions, and may be determined through routine experimentation.

In addition to the specific components and layers described above, the photographic elements of the invention may include further features and layers as are known in the art. Polyester supports, e.g., typically employ undercoat or primer layers to improve adhesion of other layers thereto. Such undercoat layers are well known in the art and comprise, e.g., a vinylidene chloride/methyl crylate/itaconic acid terpolymer or vinyldene chloride/acrylonitrile/acrylic acid erpolymer as described in U.S. Pat. Nos. 2,627,088; 2,698,235; 2,698,240; 2,943,937; 3,143,421; 3,201,249; 3,271,178; 3,501,301.

As described above, the filter dyes used in the antihalation layer are preferably designed to be solubilized and removed or decolorized during photographic processing. Conventional processing of photographic print elements include the Kodak ECP-2B Process for motion picture print films, described in Kodak Publication No. H-24, Manual For Processing Eastman Color Films.

If desired, the photographic elements of the invention can be used in conjunction with an applied magnetic layer as described in *Research Disclosure,* November 1992, Item 34390 published by Kenneth Mason Publications, Ltd., Dudley House, 12 North Street, Emsworth, Hampshire P010 7DQ, ENGLAND.

The invention will be further illustrated in the following examples:

EXAMPLE 1

Polyethylene terephthalate film supports 1.1–1.18 were prepared as follows. Film-grade polyethylene terephthalate resin, having an inherent viscosity (I.V.) as indicated below (AIM of 0.63 dl/g), is fed into a single screw extruder wherein it is heated to a temperature of about 280° C. and cast at this temperature through a die onto a casting wheel maintained at a temperature of about 50° C. The film is separated from the wheel and passed into a drafting section wherein it is stretched at a ratio as indicated below along the machine direction (MDO). In the drafting section the film is preheated to a temperature of 100° C. and stretched at a temperature of 95° C. Prior to exiting the drafting section the film is cooled by air to a temperature of 35° C. The film is then passed to a tentering zone where it is initially heated to a temperature of 85° C. and then stretched along the transverse direction at a temperature of 105° C. to a ratio as indicated below (TDO). Immediately following the tentering step heat-setting is applied wherein the film is heated under constraint to a temperature such that its actual heatset temperature (as determined by DSC) is as indicated below. In the above process, a subbing terpolymer of acrylonitrile, vinylidene chloride and acrylic acid was applied to the back side and a subbing terpolymer of methylacrylate, vinylidene chloride and itaconic acid was applied to the front (emulsion) side of the support before drafting and tentering so that the final coating weights were each about 90 mg/m$^2$. The heat set PET film base is then cooled by air under a tenter cooling pressure as indicated below (AIM 0.6 inch $H_2O$) to obtain a biaxially orientated, heat-set polyethylene terephthalate film of approximately 120 micrometer thickness.

Each biaxially orientated, polymer subbed support was coated on the back side with an aqueous antistatic layer comprising 4.3 mg/m$^2$ vanadium pentoxide silver-doped at 8%, 4.3 mg/m$^2$ of a terpolymer latex of acrylonitrile, vinylidene chloride, and acrylic acid, and 3.2 mg/m$^2$ of coating aid Triton™ X100. On top of the antistatic layer was applied an overcoat barrier layer comprising (AIM coverage) 965 mg/m2 Witcobond™ W232 (Witco) polyurethane, 58 mg/m$^2$ of Neocryl™ CX-100 crosslinker (Zeneca), 21 mg/m$^2$ of (poly)methyl metbacrylate beads, 31 mg/m$^2$ of Triton™ X100, and 1 mg/m$^2$ of Michemlube-160™. A gelatin subbing layer was coated on the front (emulsion) side. The back coated and gel sub coated oriented film supports were then heat relaxed (AIM temperature 127° C. (260° F.) for an AIM time of 1.9 minutes) to relax strains and to build adhesion. The backcoated and subbed PET film base was finally cooled by air and wound up onto a core.

Polymer intrinsic viscosity (I.V.), heat relaxation time, backing overcoat coverage, machine direction orientation (MDO), transverse direction orientation (TDO), heatset temperature, heat relaxation temperature, and tenter cooling pressure were varied in the preparation of the formed supports 1.1–1.18 in accordance with the following Taguchi design array illustrated in Table 1:

TABLE 1

| Support No. | Polymer I.V. (AIM = 0.63 d.l/g) | Heat Relaxation Time (AIM = 1.9 min) | Backing Overcoat Coverage (AIM = 1000 mg/m$^2$) | MDO Ratio | TDO Ratio | Heatset Temp. (° C.) | Heat Relax Temp. (AIM = 127° C.) | Tenter Cooling Press (AIM = 0.6 inch $H_2O$) |
|---|---|---|---|---|---|---|---|---|
| 1.1 | AIM | 0.7 AIM | 0.5 AIM | 3.30 | 3.30 | 208 | AIM − 8 | 0.7 AIM |
| 1.2 | AIM | 0.7 AIM | AIM | 3.45 | 3.45 | 216 | AIM − 8 | AIM |
| 1.3 | AIM | 0.7 AIM | 1.5 AIM | 3.60 | 3.60 | 224 | AIM + 8 | 1.3 AIM |
| 1.4 | AIM | AIM | 0.5 AIM | 3.30 | 3.45 | 216 | AIM + 8 | 1.3 AIM |
| 1.5 | AIM | AIM | AIM | 3.45 | 3.60 | 224 | AIM − 8 | 0.7 AIM |
| 1.6 | AIM | AIM | 1.5 AIM | 3.60 | 3.30 | 208 | AIM | AIM |
| 1.7 | AIM | 1.3 AIM | 0.5 AIM | 3.45 | 3.30 | 224 | AIM | 1.3 AIM |
| 1.8 | AIM | 1.3 AIM | AIM | 3.60 | 3.45 | 208 | AIM + 8 | 0.7 AIM |
| 1.9 | AIM | 1.3 AIM | 1.5 AIM | 3.30 | 3.60 | 216 | AIM − 8 | AIM |
| 1.10 | AIM − 0.04 | 0.7 AIM | 0.5 AIM | 3.60 | 3.60 | 216 | AIM | 0.7 AIM |
| 1.11 | AIM − 0.04 | 0.7 AIM | AIM | 3.30 | 3.30 | 224 | AIM + 8 | AIM |
| 1.12 | AIM − 0.04 | 0.7 AIM | 1.5 AIM | 3.45 | 3.45 | 208 | AIM − 8 | 1.3 AIM |
| 1.13 | AIM − 0.04 | AIM | 0.5 AIM | 3.45 | 3.60 | 208 | AIM + 8 | AIM |
| 1.14 | AIM − 0.04 | AIM | AIM | 3.60 | 3.30 | 216 | AIM − 8 | 1.3 AIM |
| 1.15 | AIM − 0.04 | AIM | 1.5 AIM | 3.30 | 3.45 | 224 | AIM | 0.7 AIM |
| 1.16 | AIM − 0.04 | 1.3 AIM | 0.5 AIM | 3.60 | 3.45 | 224 | AIM − 8 | AIM |
| 1.17 | AIM − 0.04 | 1.3 AIM | AIM | 3.30 | 3.60 | 208 | AIM | 1.3 AIM |
| 1.18 | AIM − 0.04 | 1.3 AIM | 1.5 AIM | 3.45 | 3.30 | 216 | AIM + 8 | 0.7 AIM |

Responses of physical properties, optical properties, and actual heatset level as measured by differential scanning calorimetry plus overall thickness uniformity were recorded from each of the 18 parts of the experiment. Master rolls of film support were made at each of the experimental conditions and sent for coating of light sensitive layers.

Multilayer color photographic elements were prepared using an antihalation layer coating melt prepared as follows. A solid particle dispersion of yellow filter dye cpd 5 was made by milling with Igepon™ T-77 (7% by weight of dye) (Rhone-Poulanc) in a manner similar to that described in Example 1 of U.S. Pat. No. 5,723,272. Solid particle dispersions of filter dyes I-1 and II-1 were also made in a manner similar to that described in Example 1 of U.S. Pat. No. 5,723,272. The solid particle dye dispersions were added to a mixture of deionized gelatin, a thickener (20/80 co-polymer of 2-propenamide and 2-methyl-2-[(1-oxo-2-propenyl)amino]-1-propanesulfonic acid, monosodium salt) and spreading aids, and then coated on the subbed polyethylene terephthalate supports 1–18. The antihalation undercoat layer was then overcoated with silver halide emulsion layers suitable for color motion picture print film and a protective overcoat in the format indicated below:

Layer 1: Antihalation Layer

Yellow filer dye cpd 5, 32.3 mg/m$^2$.

Barbituric acid oxonol cyan filter dye I-1, 37.7 mg/m$^2$.

Cyan filter dye II-1, 64.6 mg/m$^2$.

Thickener, 13.5 mg/m$^2$.

Deionized gelatin, 758.9 mg/m$^2$.

Spreading aids.

Layer 2: Blue Light Sensitive Layer

AgClBr cubic grain emulsions, <1% Br, spectrally sensitized with SD-2 and SD-3, 796 mg/m$^2$ total silver.

Yellow dye forming coupler (Y-2), 1356 mg/sq. m.

Ultraviolet absorber compound (UV-1), 134 mg/sq. m.

Sequestrant compound (SQ-1), 305.9 mg/sq. m.

Sequestrant compound (SQ-2), 100.0 mg/sq. m.

Gelatin, 2422 mg/sq. m.

Spreading aids.

Layer 3: Interlayer

Oxidized developer scavenger (SC-1), 118 mg/sq. m.

Antifoggant compound (AF-1), 5.4 mg/sq. m.

Gelatin, 610 mg/sq. m.

Spreading aids.

Layer 4: Red Light Sensitive Layer

AgClBr cubic grain emulsions, approx. 1% Br, spectrally sensitized with SD-1 and supersensitizer compound (SS-1), 473 mg/sq. m total silver.

Cyan dye forming coupler (C-2), 969 mg/sq. m.

Gelatin, 3121 mg/sq. m.

Palladium compound (P-1), 8.8 mg/sq. m.

Spreading aids.

Layer 5: Interlayer

Oxidized developer scavenger (SC-1), 79 mg/sq. m.

Gelatin, 610 mg/sq. m.

Spreading aids.

Layer 6: Green Light Sensitive Layer

AgClBr cubic grain emulsions, 1–2% Br, spectrally sensitized with SD-4 and SD-5, 607 mg/sq. m total silver.

Magenta dye forming coupler (M-1), 700 mg/sq. m.

Gelatin, 1453 mg/sq. m.

Spreading aids.

Layer 7: Protective Overcoat Layer

Poly (dimethyl siloxane) 200-CS, 16.5 mg/sq. m.

Poly (methyl methacrylate) beads, 10.7 mg/sq. m.

Gelatin, 969 mg/sq. m.

Fluorotenside FT-248 (Bayer AG), 5 mg/sq. m.

Spreading aids.

Gelatin hardener.

Soluble green absorber dyes AD-2 (118.4 mg/sq. m.), AD-3 (37.7 mg/sq. m.), and AD-4 (70 mg/sq. m.) were also distributed throughout the emulsion side layers. Couplers were dispersed with high boiling coupler solvents and/or auxiliary solvents in accordance with conventional practice in the art.

Each experimental part which had been coated with light sensitive layers was slit using slitters and perforated using conventional reciprocal perforators or a high-speed rotary T perforator finishing equipment. For all film samples, slitting and perforating conditions are identical. The amount of dirt generated during perforating is determined using the tacky tape test. In this test, dirt is transferred from films to a 3M transparent pharmaceutical grade adhesive tape. The adhesive tape is wrapped, adhesive-side out, around a roller and 80 feet of the film is transported over the roller. The roller is translated back and forth, or wobbled, so that the dirt particles cannot accumulate on top of each other. The tape is then removed and mounted on a frame for optical image analysis to provide a quantitative measure of dirt coverage. Widthwise scans are made at 10 selected locations and percentage of the tacky tape covered with dirt is recorded. The total accumulated dirt on both the emulsion and the support side surfaces of these films are examined and compared in terms of the summation of tacky tape dirt data for all sides and edges of the films. The key responses of normalized average slitting, perforating, and overall dirt concentrations reported in Table 2 below as a factor of MDO Ratio, TDO Ratio, and Heatset Temperature represent the mean for experimental conditions 1.1–1.18 indicated in Table 1 when the given control factor was set at a given level. The normalized thickness standard deviations are also indicated.

TABLE 2

| Control Factor | Level | Normalized Average Slitting Dirt | Normalized Average Perforating Dirt | Normalized Overall Dirt | Normalized Thickness Standard Deviation |
|---|---|---|---|---|---|
| MDO Ratio | 3.30 | 0.94 | 0.87 | 0.91 | 0.77 |
| | 3.45 | 0.79 | 0.85 | 0.82 | 0.70 |
| | 3.60 | 0.61 | 0.96 | 0.79 | 0.78 |
| TDO Ratio | 3.30 | 0.80 | 0.87 | 0.84 | 1.00 |
| | 3.45 | 0.80 | 0.96 | 0.88 | 0.72 |
| | 3.60 | 0.75 | 0.86 | 0.80 | 0.53 |
| Heatset Temperature (° C.) | 208 | 0.90 | 0.96 | 0.93 | 0.81 |
| | 216 | 0.75 | 0.91 | 0.83 | 0.66 |
| | 224 | 0.70 | 0.82 | 0.76 | 0.78 |

The results of the support experiment showed that photographic films comprising an antihalation undercoat and a PET film base made by the process described above employing high heatset temperatures and high levels of stretching as measured by MDO and TDO ratios generated significantly less dirt and debris upon being slit and rotary perforated while achieving excellent thickness uniformity of the support. Planar birefringence was consistently approximately 0.16, showing no variation over the wide range of film support making process conditions employed. These responses show that moderate to high levels of orientation and especially higher heatset levels will simultaneously yield reductions in slitting and perforating dirt. At the highest heatset level high orientation will also provide excellent thickness uniformity which is important for winding of long master rolls of film and slits of film for customer use.

Example 2

Multilayer color photographic materials are made by coating the following layers on a biaxially orientated (MDO=3.45, TDO=3.60) heat set (Heatset temp.=224° C.) polyethylene terephthalate film base having an antistatic backcoat as described in Example 1.

Layer 1: Antihalation Layer

Yellow filer dye cpd 5, 54 mg/m$^2$.

Barbituric acid oxonol filter dye I-2, 128 mg/m$^2$.

Thickener, 25 mg/m$^2$.

Deionized gelatin, 758.9 mg/m$^2$.

Spreading aids.

Layer 2: Blue Light Sensitive Layer

AgClBr cubic grain emulsion, 0.28% Br, 0.72 micron, spectrally sensitized with SD-2, 0.1220 mmole/Ag mole and with SD-3, 0.1237 mmole/Ag mole, 278.8 mg/sq. m.

AgClBr cubic grain emulsion, 0.44% Br, 0.40 micron, spectrally sensitized with SD-2, 0.2277 mmole/Ag mole and with SD-3, 0.2310 mmole/Ag mole, 382.1 mg/sq. m.

AgClBr cubic grain emulsion, 0.45% Br, 0.32 micron, spectrally sensitized with SD-2, 0.1491 mmole/Ag mole and with SD-3, 0.1512 mmole/Ag mole, 135.6 mg/sq. m.

Yellow dye forming coupler (Y-2), 1334.7 mg/sq. m.

Ultraviolet absorber compound (UV-1), 107.6 mg/sq. m.

Sequestrant compound (SQ-1), 305.9 mg/sq. m.

Sequestrant compound (SQ-2), 100.0 mg/sq. m.

Gelatin, 2583.4 mg/sq. m.

Spreading aids.

Layer 3: Interlayer

Oxidized developer scavenger (SC-1), 86.1 mg/sq. m.

Antifoggant compound (AF-1), 2.7 mg/sq. m.

Gelatin, 645.6 mg/sq. m.

Spreading aids.

Layer 4: Red Light Sensitive Layer

AgClBr cubic grain emulsion, 0.60% Br, 0.21 micron, spectrally sensitized with SD-1, 0.043 mmole/Ag mole, supersensitizer compound (SS-1), 0.263 mmole/Ag mole, 68.9 mg/sq. m.

AgClBr cubic grain emulsion, 0.87% Br, 0.15 micron, spectrally sensitized with SD-1, 0.051 mmole/Ag mole, supersensitizer compound (SS-1), 0.344 mmole/Ag mole, 346.6 mg/sq. m.

AgClBr cubic grain emulsion, 1.12% Br, 0.11 micron, spectrally sensitized with SD-1, 0.045 mmole/Ag mole, supersensitizer compound (SS-1), 0.336 mmole/Ag mole, 79.7 mg/sq. m.

Cyan dye forming coupler (C-2), 1022.6 mg/sq. m.

Gelatin, 3229.2 mg/sq. m.

Palladium compound (P-1), 8.1 mg/sq. m.

Spreading aids.

Layer 5: Interlayer

Oxidized developer scavenger (SC-1), 86.1 mg/sq. m.

Antifoggant compound (AF-1), 2.7 mg/sq. m.

Gelatin, 645.6 mg/sq. m.

Spreading aids.

Layer 6: Green Light Sensitive Layer

AgCIBr cubic grain emulsion, 1.35% Br, 0.21 micron, spectrally sensitized with SD-4, 0.228 mmole/Ag mole and with SD-5, 0.005 mmole/Ag mole, 61.4 mg/sq. m.

AgClBr cubic grain emulsion, 2.10% Br, 0.15 micron, spectrally sensitized with SD-4, 0.323 nunole/Ag mole and with SD-5, 0.007 mmole/Ag mole, 355.2 mg/sq. m.

AgClBr cubic grain emulsion, 1.75% Br, 0.11 micron, spectrally sensitized with SD-4, 0.363 mmole/Ag mole and with SD-5, 0.008 mmole/Ag mole, 57.0 mg/sq. m.

Magenta dye forming coupler (M-1), 721.2 mg/sq. m.

Gelatin, 1872.9 mg/sq. m.

Spreading aids.

Layer 7: Protective Overcoat Layer

Poly (dimethyl siloxane) 200-CS, 16.5 mg/sq. m.

Poly (methyl methacrylate) beads, 16.1 mg/sq. m.

Gelatin, 977.4 mg/sq. m.

Gelatin hardener.

Spreading aids.

Fluorotenside FT-248 (Bayer AG)

Soluble green absorber dye AD-1 (32.3 mg/sq. m.), soluble green absorber dye AD-2 (48.4 mg/sq. m.), soluble blue absorber dye AD-3 (48.4 mg/sq. m.), and soluble red absorber dye AD-4 (96.9 mg/sq. m.) are also distributed throughout the emulsion side layers. Couplers are dispersed with high boiling coupler solvents and/or auxiliary solvents in accordance with conventional practice in the art.

The level of Fluorotenside FT-248 is varied in the protective overcoat layer at levels of 2.7, 5.4, 8.1 and 10.7 mg/m$^2$ to control the surface charge differential between the element emulsion side and back side surfaces. Improved performance with respect to the generation of dirt and debris (i.e., lower levels) upon being slit and rotary perforated is observed for films having lower surface charged differentials between the emulsion and back sides of the element, and particularly good results are obtained where the surface charge differential is less than 6 microcoulombs/m$^2$.

The following structures represent compounds utilized in the above photographic elements.

yellow filter dye cpd 5

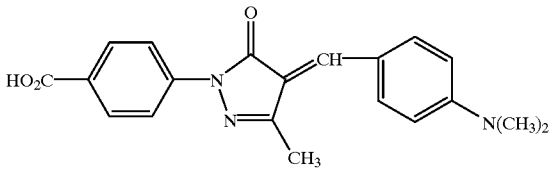

-continued
Filter Dye I-1
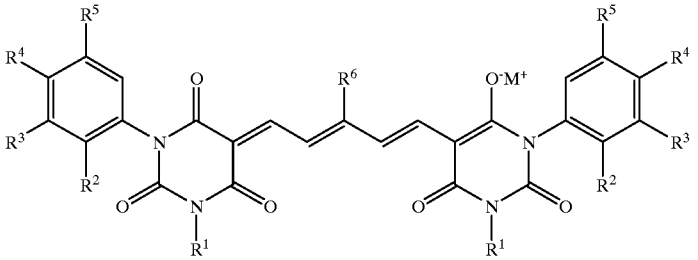
$R^1$, $R^2$, $R^3$, $R^5$, $R^6$ = H; $R^4$ = OH; $M^+$ = triethylammonium
Filter Dye I-2
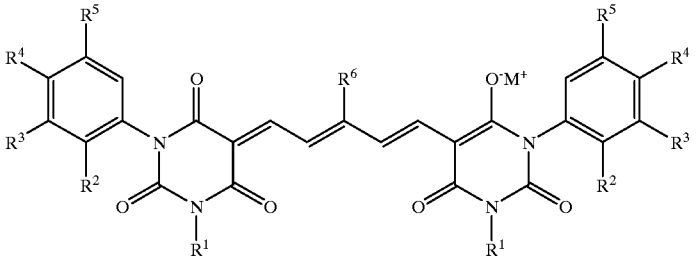
$R^1$, $R^2$, $R^3$, $R^5$, $R^6$ = H; $R^4$ = $CO_2H$; $M^+$ = triethylammonium
Filter Dye II-1
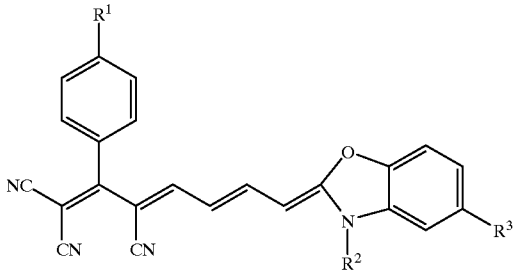
$R^1$, $R^3$ = $NHSO_2CH_3$; $R^2$ = $CH_3$
supersensitizer SS-1
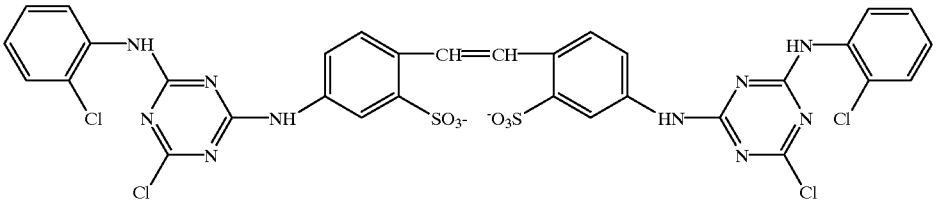
•$2Na^+$ -continued
red sensitizing dye SD-1
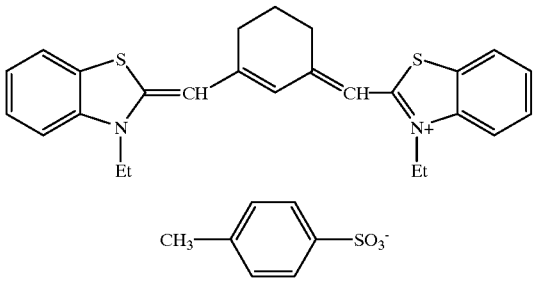
blue sensitizing dye SD-2 and SD-3
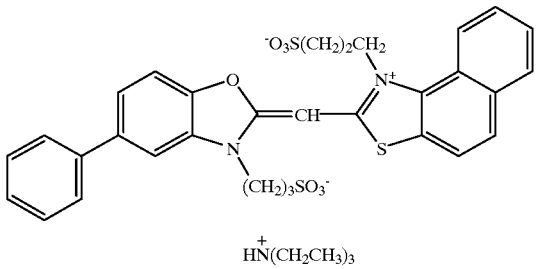
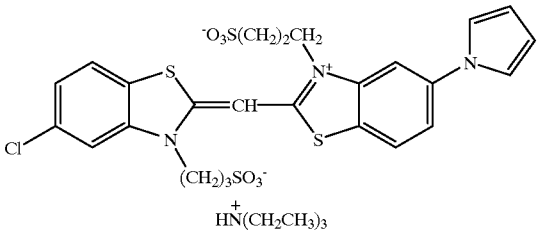
yellow coupler Y-2
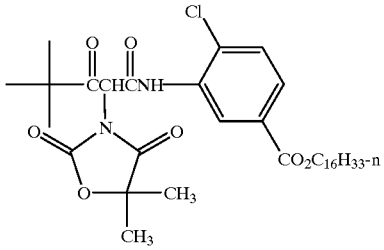
Ultraviolet absorber compound UV-1
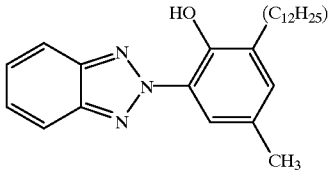
mixed branch and linear $C_{12}H_{25}$
sequestrant SQ-1
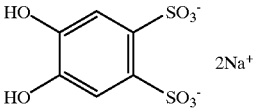
sequestrant SQ-2
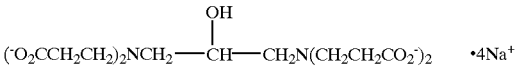
scavenger SC-1
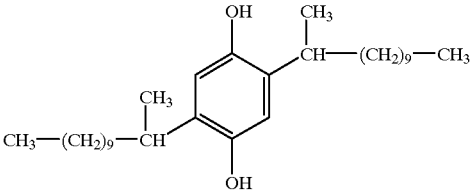
Antifoggant compound AF-1
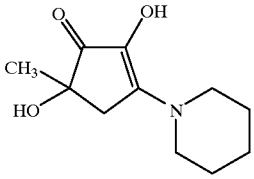
Cyan Coupler C-2
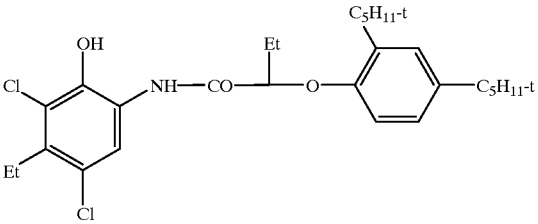
Palladium compound P-1
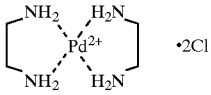

-continued
green sensitizing dye SD-4 and SD-5
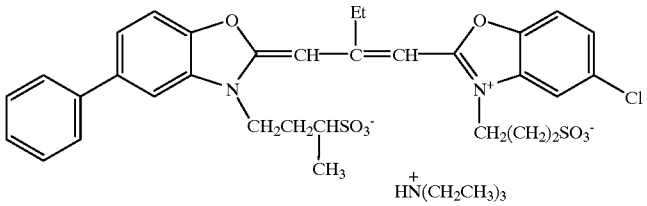
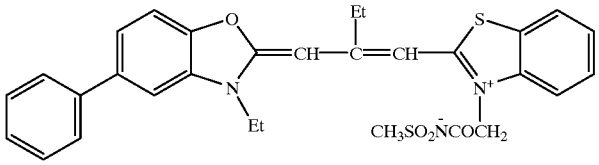
magenta coupler M-1
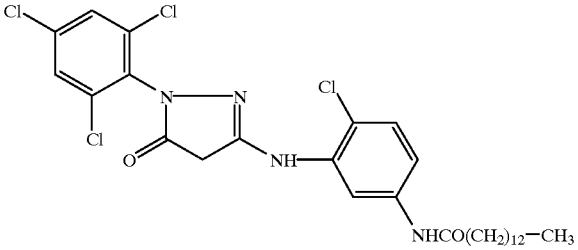
soluble green filter dye AD-1
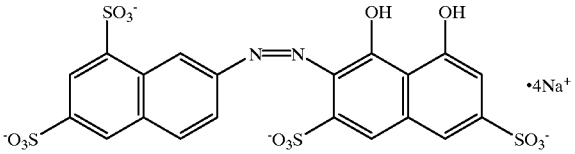
soluble green filter dye AD-2
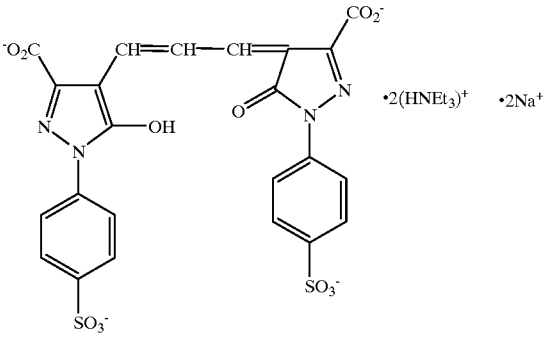
soluble blue filter dye AD-3
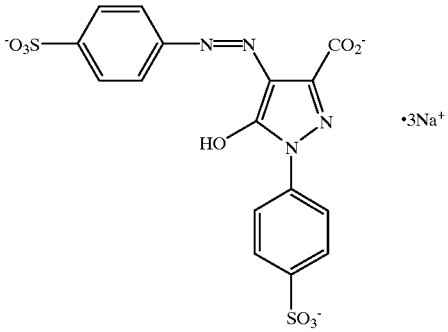

-continued soluble red filter dye AD-4

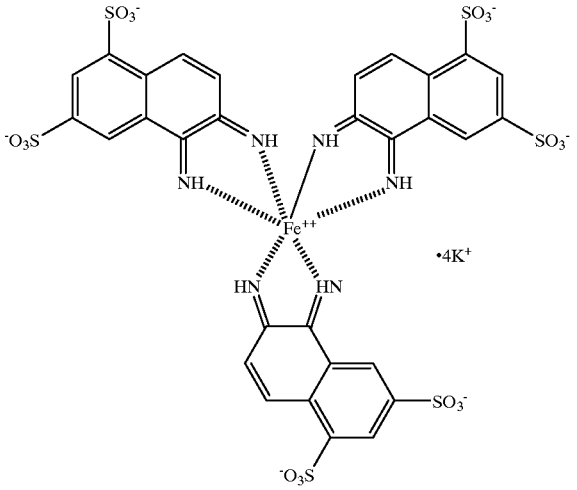

PINA Filter Dye Bluegreen
from Riedel deHaen

This invention has been described in detail with particular reference to preferred embodiments thereof. It will be understood that variations and modifications can be made within the spirit and scope of the invention.

What is claimed is:

1. A silver halide light sensitive photographic element comprising a polyethylene terephthalate film base, at least one light sensitive silver halide-containing emulsion layer, an antihalation undercoat layer, and a process-surviving antistatic backcoat, wherein the polyethylene terephthalate film base is formed by:

(a) casting a molten polyethylene terephthalate resin in a machine direction onto a casting surface to form a continuous sheet, (b) drafting the sheet by stretching in the machine direction at a stretch ratio of from 3.4 to 4, and at a temperature ranging from 70 to 130° C., (c) tentering the sheet in the transverse direction by stretching at a stretch ratio of from 3.4 to 4, and at a temperature ranging from 70 to 130° C., (d) heat-setting the tentered sheet at an actual temperature sensed by the sheet of at least 216° C., and (e) cooling the heat-set sheet without substantial detentering to obtain a stretched, heat-set polyethylene terephthalate film.

2. The element of claim 1 wherein the antihalation undercoat comprises filter dyes which are incorporated in the form of solid particle dispersions which are readily solubilized and removed or decolorized upon standard photographic processing.

3. The element of claim 1 wherein the antihalation undercoat comprises a blue light absorbing (yellow colored) merostyryl, monomethine oxonol and/or arylidene filter dye at a combined coverage of from about 10–500 mg/m$^2$ and a red light absorbing barbituric acid oxonol filter dye at coverage from about 10–500 mg/m$^2$.

4. The element of claim 1 wherein the actual heat-set temperature of the film is determined from a secondary melting endothermic peak of a differential scanning calorimetry thermogram.

5. The element of claim 1 wherein in step (b) the sheet is stretched in the machine direction at a temperature ranging from 85 to 110° C., and in step (c) the sheet is stretched in the transverse direction at a temperature ranging from 90 to 115° C.

6. The element of claim 1 wherein the actual heat-set temperature is at least 224° C.

7. The element of claim 1 wherein the molten polyester resin has an inherent viscosity of from 0.5 to 0.8 dl/g, is cast at a temperature of from 270 to 300° C., and the casting surface has a temperature of from 40 to 70° C.

8. The element of claim 1 wherein the planar birefringence of the polyethylene terephthalate film is between 0.150 and 0.164.

9. The element of claim 8 wherein the actual heat-set temperature is at least 224° C.

10. The element of claim 1 wherein the actual heat-set temperature of the film base is at least 230° C.

11. The element of claim 1 wherein the surface charge differential between the surface of the element on the side of the support to which the emulsion layer is coated and the backcoat side is less than 12 microcoulombs/m$^2$.

12. The element of claim 1 wherein the surface charge differential between the surface of the element on the side of the support to which the emulsion layer is coated and the backcoat side is less than 6 microcoulombs/m$^2$.

13. The element of claim 1 wherein the polyethylene terephthalate film base drafting stretch ratio is from 3.6 to 4.0.

14. The element of claim 1 wherein the polyethylene terephthalate film base tentering stretch ratio is from 3.6 to 4.0.

* * * * *